US006206644B1

(12) United States Patent
Pereira et al.

(10) Patent No.: US 6,206,644 B1
(45) Date of Patent: Mar. 27, 2001

(54) COMPACT DUAL PUMP

(75) Inventors: Jerome T. Pereira, San Jose; Robert E. Woodworth, Sunnyvale, both of CA (US)

(73) Assignee: Microbar Systems, Inc., Sunnyvale, CA (US)

( * ) Notice: Subject to any disclaimer, the term of this patent is extended or adjusted under 35 U.S.C. 154(b) by 0 days.

(21) Appl. No.: 09/370,076

(22) Filed: Aug. 6, 1999

(51) Int. Cl.[7] ..... F04B 19/24
(52) U.S. Cl. ..... 417/53
(58) Field of Search ..... 417/53, 392, 393, 417/395, 413, 521

(56) References Cited

U.S. PATENT DOCUMENTS

| | | | | |
|---|---|---|---|---|
| 5,240,390 | * | 8/1993 | Kvinge et al. | 417/393 |
| 5,429,681 | * | 7/1995 | Mesenbring | 417/395 |
| 5,458,468 | * | 10/1995 | Ye | 417/395 |
| 6,071,090 | * | 6/2000 | Miki | 417/395 |
| 6,106,246 | * | 8/2000 | Steck et al. | 417/395 |

OTHER PUBLICATIONS

Parker Instrumentation Data Sheet, Parker Hannifin Corporation, "Disk Check Valve: CV–1 Series", p. 25.

Millipore Corporation Data Sheet, "Wafergard Chemical Dispense Pumps" by Dispense Systems, p. 232.

Millipore Corporation Data Sheet, "Wafergard Chemical Dispense System Controllers" by Dispense Systems, p. 233.

Millipore Corporation Data Sheet, "WCDP Pump; Appendix 3: Parts List of Non–Filter Pump" by Dispense Systems, p. 104.

* cited by examiner

*Primary Examiner*—Charles G. Freay
*Assistant Examiner*—W. Rodriguez
(74) *Attorney, Agent, or Firm*—Flehr Hohbach Test Albritton & Herbert LLP

(57) ABSTRACT

A dual pump for independently pumping two fluids includes a pump body having a first concave depression on a first side of the body. A first inlet port and a first outlet port are contained within the body, in fluid communication with the first depression. A second concave depression is on a second side of the body opposite the first depression. A second inlet port and a second outlet port are contained within the body in fluid communication with the second depression. A first diaphragm is coupled to the first side of the body and encloses the first depression to form a first inner chamber. A second diaphragm is coupled to the second side of the body and encloses the second depression to form a second inner chamber. A shell encloses the body on its first and second sides. The shell defines a first outer chamber with the first diaphragm in pressure communication with the first inner chamber. The shell also defines a second outer chamber with the second diaphragm in pressure communication with the second inner chamber. A first pressure port in the shell provides a first pressure passage to the first outer chamber. A second pressure port in the shell provides a second pressure passage to the second outer chamber. Advantages include simultaneously and independently providing two fluid pumps within a pump that is substantially the same size as a conventional single pump. Alternatively, the pump is configured to supply a continuous, non-pulse flow of a single liquid.

10 Claims, 10 Drawing Sheets

COMPACT DUAL PUMP

REFERENCE TO RELATED APPLICATIONS

This application incorporates by reference U.S. Pat. No. 5,700,401.

FIELD

The present invention relates to a compact dual pump for delivering liquid to an integrated circuit fabrication tool. In particular, the invention can be used in a standard integrated circuit manufacturing facility to save space and provide required liquids to the integrated circuit fabrication tools, resulting in a greater production efficiency of integrated circuits.

BACKGROUND

Liquid pumps are used in the semiconductor manufacturing industry to control the flow of chemicals to semiconductor manufacturing tools. Conventional pumps include those that pneumatically activate a bladder to precisely control the quantity of liquid delivered to the tools. Precise control of the liquid is important because each wafer is very valuable and an incorrect flow of the liquid to the tool can spoil the construction of integrated circuits fabricated on the wafer.

Semiconductor manufacturing facilities are expensive. A modern plant can cost in excess of $3 billion. Consequently, space is critical and every square foot of space in the facility must be allocated to productive equipment. Accordingly, techniques of space reduction are greatly desired because space reduction can result in substantial cost savings. Improving space utilization leads to greater production efficiency which allows the facility to produce more integrated circuits.

While conventional liquid pumps have the accurate flow control necessary for the integrated circuit fabrication process, conventional pumps are bulky, a pump is required for each liquid sought to be delivered to the tools, and the pumps can take up a significant amount of space in the chemical delivery cabinets installed in the semiconductor manufacturing facility.

What is needed is a pump that has a small size and that also provides the ability to precisely pump the required liquid to the tool. A goal of the invention is to overcome the identified limitations and to provide a compact dual pump that can simultaneously and independently pump two liquids to the tool.

SUMMARY

The present invention is directed to a device which results in substantial space reduction by combining two pumps into substantially the space of one conventional pump. Accordingly, the dual pump is able to simultaneously pump two different chemicals independent of one another. Alternately, the second pump can serve as a redundant pump to insure that the liquid is constantly supplied to the integrated circuit fabrication tool. In addition, the dual pump can function as a single pump such that a continuous, non-pulsation flow of liquid is provided.

An exemplary embodiment of a compact dual pump includes a pump body having a first concave depression on a first side of the body. A first fluid inlet port and a first fluid outlet port are contained within the body and are in fluid communication with the first depression. A second concave depression is on a second side of the body opposite the first depression. A second inlet fluid port and a second outlet fluid port are contained within the body and in fluid communication with the second depression.

A first diaphragm is coupled to the first side of the body and encloses the first depression to form a first inner chamber. A second diaphragm is coupled to the second side of the body and encloses the second depression to form a second inner chamber. A shell encloses the body on the first and second sides thereof. The shell defines a first outer chamber with the first diaphragm that is pressure communication with the first inner chamber. The shell also defines a second outer chamber with the second diaphragm that is in pressure communication with the second inner chamber. A first pressure port in the shell provides a first pressure passage to the first outer chamber. A second pressure port in the shell provides a second pressure passage to the second outer chamber.

In another embodiment, the dual pump includes two pairs of bores aligned with the four fluid ports. A pair of check valves are disposed within the first pair of bores and define a first fluid path between the first fluid port and the first inner chamber. A second pair of check valves are disposed with the other pair of bores and define a second fluid path between the second fluid port and the second inner chamber. A pump regulator is connected to the first and second pressure ports and independently provides either pressure or vacuum to the first and second outer chambers to affect fluid movement in the dual pump chambers.

Advantages of the present invention include the ability to simultaneously and independently provide two fluid chambers within a pump that is substantially the same size as conventional single pump.

BRIEF DESCRIPTION OF THE FIGURES

Additional advantages of the invention will become apparent upon reading the following detailed description and upon reference to the drawings, in which.

DETAILED DESCRIPTION

Figure 2:
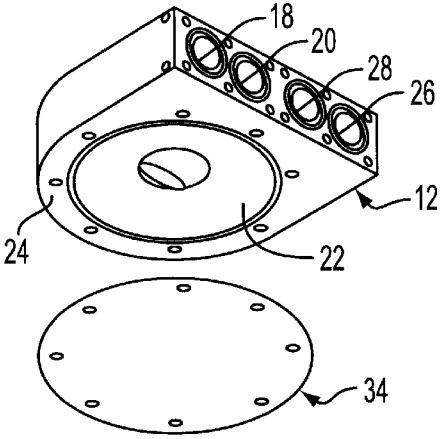
FIG. 2 depicts a bottom view of the pump body according to an exemplary embodiment of the invention.
Figure 4:
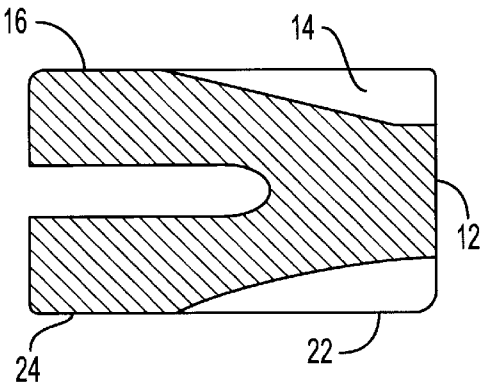
FIG. 4 depicts a cross-sectional view of the pump body according to an exemplary embodiment of the invention.
Figure 1:
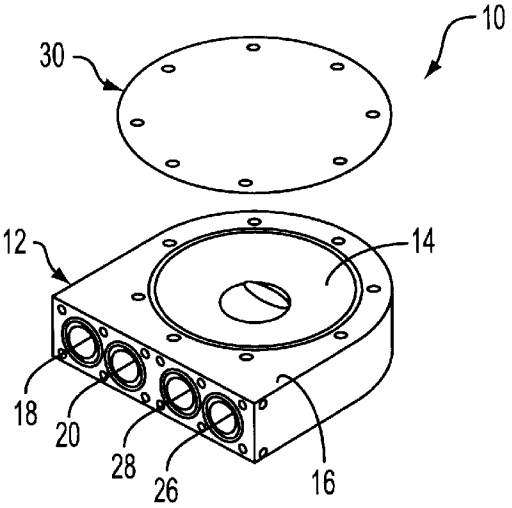
FIG. 1 depicts a top view of the pump body according to an exemplary embodiment of the invention.
Figure 3:
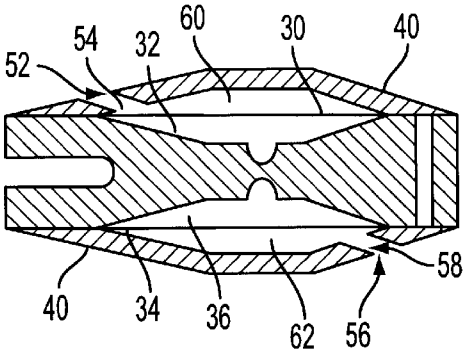
FIG. 3 depicts a cross-sectional view of the dual pump according to an exemplary embodiment of the invention.

The present invention relates to a compact dual pump structure 10. In particular, the invention can be used in a standard cleaning room which can utilize the two separate fluid paths in a single body for independent transfer of two chemistries resulting in greater production of integrated circuits. Although the present invention is described with reference to specific configurations, it will be appreciated by one of ordinary skill in the art that such details are disclosed simply to provide a more thorough understanding of the present invention and the present invention may be practiced without these specific details.

An exemplary embodiment of a compact dual pump 10 is described with reference to FIGS. 1 to 4. A dual pump 10 for pumping a first fluid and a second fluid simultaneously and independently is depicted. The dual pump 10 is comprised of a pump body 12. The pump body 12 includes a first concave depression 14 on a first side 16 of the pump body 12. A first inlet fluid port 18 and a first outlet fluid port 20 are contained within the pump body 12 and are in fluid communication with the first depression 14. A second concave depression 22 is on a second side 24 of the pump body 12 opposite the first depression 14. A second inlet fluid port 26 and a second outlet fluid port 28 are also contained within the pump body 12 and in fluid communication with the second depression 22.

A first diaphragm 30 coupled to the first side 16 of the pump body 12, is suspended over the first depression 14 to enclose the first depression 14 and forms a first inner chamber 32. A second diaphragm 34 is coupled to the second side 24 of the pump body 12, suspended over the second depression 22, to enclose the second depression 22 and form a second inner chamber 36. A shell 40 encloses the pump body 12 on the first 16 and second 24 sides of the pump body 12. The shell 40 defines a first outer chamber 60 with the first diaphragm 30 that is in pressure communication with the first inner chamber 32. The shell 40 also defines a second outer chamber 62 with the second diaphragm 34 that is in pressure communication with the second inner chamber 36. A first pressure port 52 in the shell 40 provides a first pressure passage 54 to the first outer chamber 60. A second pressure port 56 in the shell 40 provides a second pressure passage 58 to the second outer chamber 62.

Figure 7:
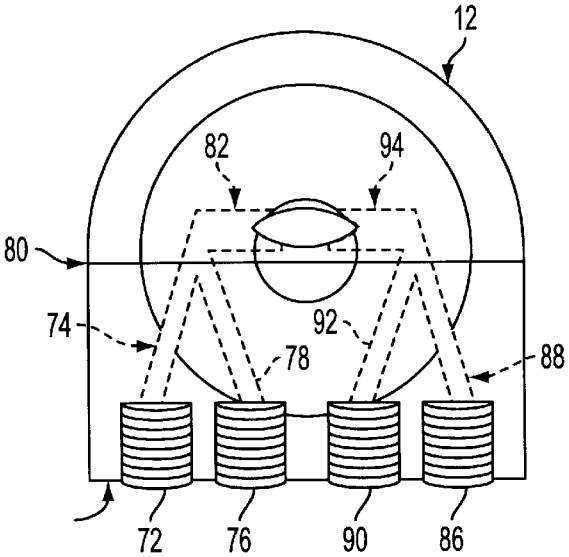
FIG. 7 depicts a top, cross-sectional of the pump body according to an exemplary embodiment of the invention.
Figure 6B:
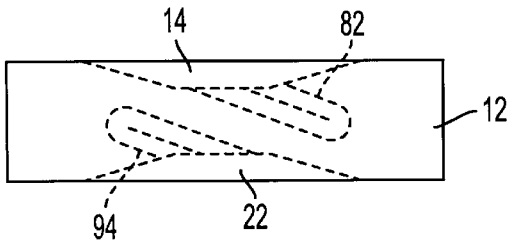
FIG. 6B depicts a rear view of the pump body according to an exemplary embodiment of the invention.
Figure 5:
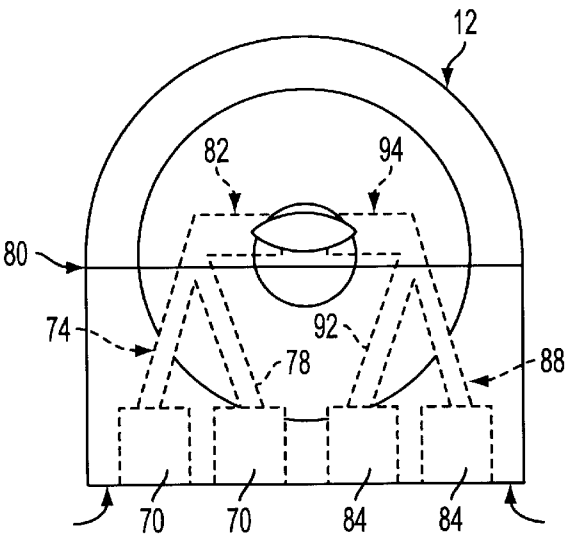
FIG. 5 depicts a top, cross-sectional view of the pump body according an exemplary embodiment of the invention.
Figure 6A:
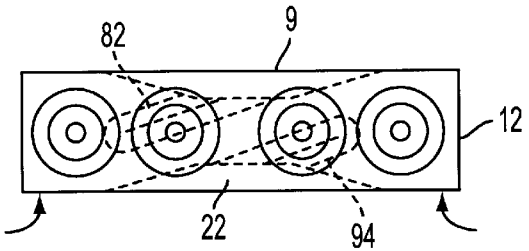
FIG. 6A depicts a front view of the pump body according to an exemplary embodiment of the invention.

As depicted in FIGS. 5 to 7, the pump body 12 further includes a pair of first bores 70 in alignment with the first inlet 18 and outlet 20 fluid ports. A first inlet check valve 72 is contained within one of the first bores 70 and defines a first inlet fluid path 74. The first inlet fluid path 74 connects the first inlet fluid port 18 to the first inner chamber 32 and allows a first fluid to flow into the first inner chamber 32 from the first inlet port 18. A first outlet check 76 valve is contained within another of the first bores 70 and defines a first outlet fluid path 78. The first outlet fluid path 78 joins the first inlet fluid path 74 at a center portion 80 of the body 12 and forms a first fluid path 82 to the first inner chamber 32. The first fluid path 82 allows the first fluid to flow out of the first inner chamber 32 through the first outlet port 20.

The pump body 12 also contains a pair of second bores 84 in alignment with the second inlet 26 and outlet 28 fluid ports. A second inlet check valve 86 is contained within one of the second bores 84 and defines a second inlet fluid path 88. The second inlet fluid path 88 connects the second inlet fluid port 26 to the second inner chamber 36 and allows a second fluid to flow into the second inner chamber 36 from the second inlet port 26. A second outlet check valve 90 is contained within another of the second bores 84 and defines a second outlet fluid path 92. The second outlet fluid path 92 joins the second inlet fluid path 88 at the center portion 80 of the body 12 to form a second fluid path 94 to the second inner chamber 36. The second fluid path 94 allows the second fluid to flow out of the second inner chamber 36 through the second outlet port 28 and out of the dual pump 10 independent of the first liquid 13.

Figure 8:
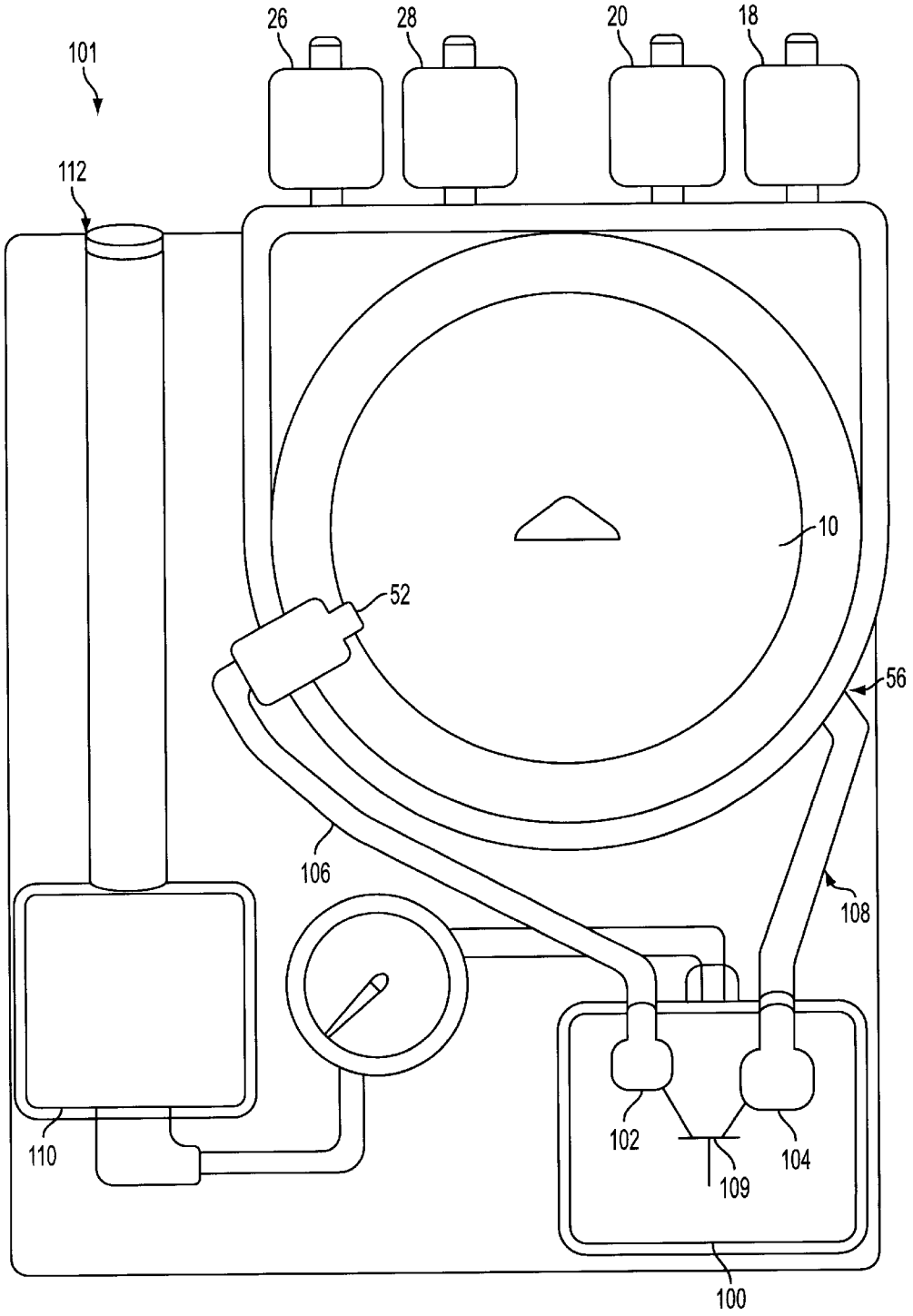
FIG. 8 depicts a module card according to a further embodiment of the invention.
Figure 9:
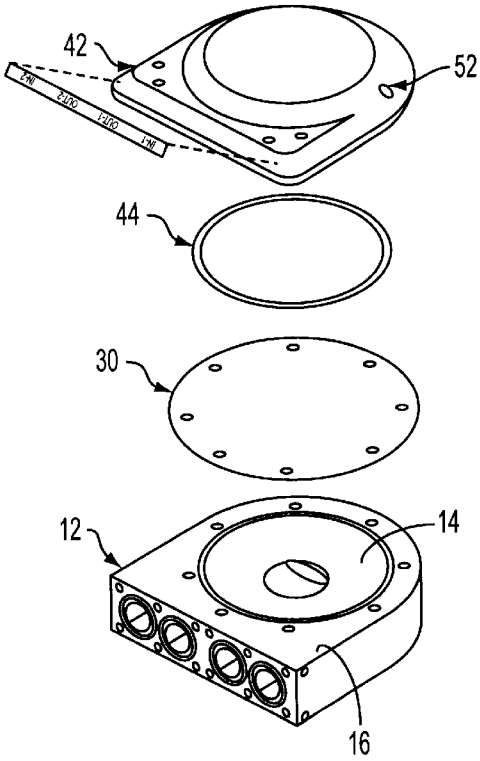
FIG. 9 depicts a top view of dual pump according to a further embodiment of the invention.
Figure 10:
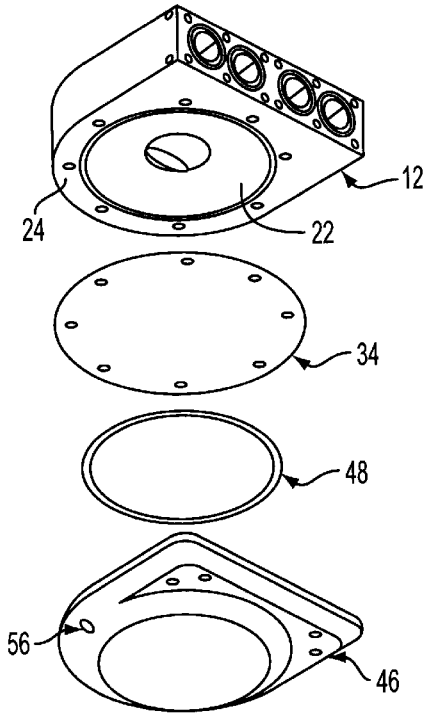
FIG. 10 depicts a bottom view of the dual pump according to a further embodiment of the invention.
Figure 11:
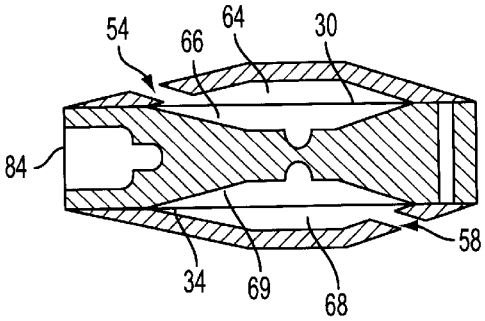
FIG. 11 depicts a cross-sectional view of the dual pump according to a further embodiment of the invention.
Figure 12:
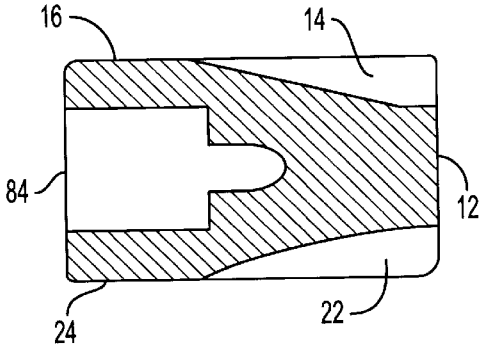
FIG. 12 depicts a cross-sectional view of the pump body according to a further embodiment of the invention.
Figure 13:
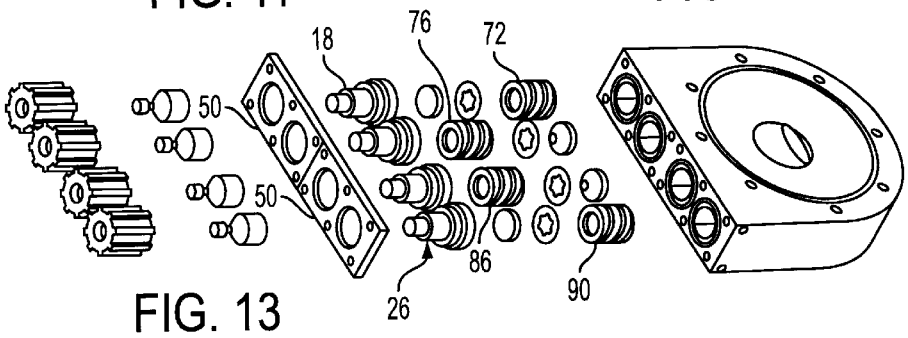
FIG. 13 depicts the pump body according to a further embodiment of the invention.

To operate the dual pump 10, a module card 100 is depicted in FIG. 8, containing a first control valve 102 that is in fluid communication with the first pressure port 52 through a first gas line 106 and a second control valve 104 that is in fluid communication with the second pressure port 56 through a second gas line 108. The control valves independently provide either vacuum or pressure to the first 30 and second 34 diaphragms to affect fluid movement. A pump regulator 110 is in fluid communication with the module card 100 and is configured to provide driving pressure for the first diaphragm 30 and the second diaphragm 34. The regulator 110 also includes a connector 112 for coupling to a gas source such as a clean dry air supply (CDA) or a nitrogen (N2) source.

In an exemplary embodiment, a first pneumatic gas line 106 connects the first pneumatic control valve 102 to the first pressure port 52. A second pneumatic gas line 108 connects the second pneumatic control valve 104 to the second pressure port 56. In addition, a vacuum switch 109 is coupled to each of the first 102 and second 104 pneumatic control valves. The vacuum switch 109 is configured to detect inadequate vacuum from the pump 10 and leak detection from the first 106 and second 108 pneumatic lines.

Another embodiment of the dual pump 10, is depicted in FIGS. 9 to 14, wherein the first outer chamber 60 is a first pneumatic chamber 64 and the first inner chamber 32 is a first fluid chamber 66 in pressure communication with the first pneumatic chamber 64. The second outer chamber 62 is a second pneumatic chamber 68 and the second inner chamber 36 is a second fluid chamber 69 in pressure communication with the second pneumatic chamber 68. In addition, the shell 40 her comprises a first end cap 42 that is coupled to the first side 16 of the pump body 12 and carries the first diaphragm 30 therebetween. The first end cap defines the first pneumatic chamber 64 between the first diaphragm 30 and the first end cap 42. A first O-ring 44 is contained within the first pneumatic chamber 64 and is coupled between the first diaphragm 30 and the first end cap 42. A second end cap 46 is coupled to the pump body 12 and carries the second diaphragm 34 therebetween. The second end cap 46 defines the second pneumatic chamber 68 between the second diaphragm 34 and the second end cap 46. A second O-ring 48 is contained within the second pneumatic chamber 68 and is coupled between the second diaphragm 34 and the second end cap 46. A cinch plate 50 is coupled to the pump body 12 and connects the first inlet 18 and outlet ports 20 and the second inlet 26 and outlet ports 28 to the pump body 12.

Figure 15:
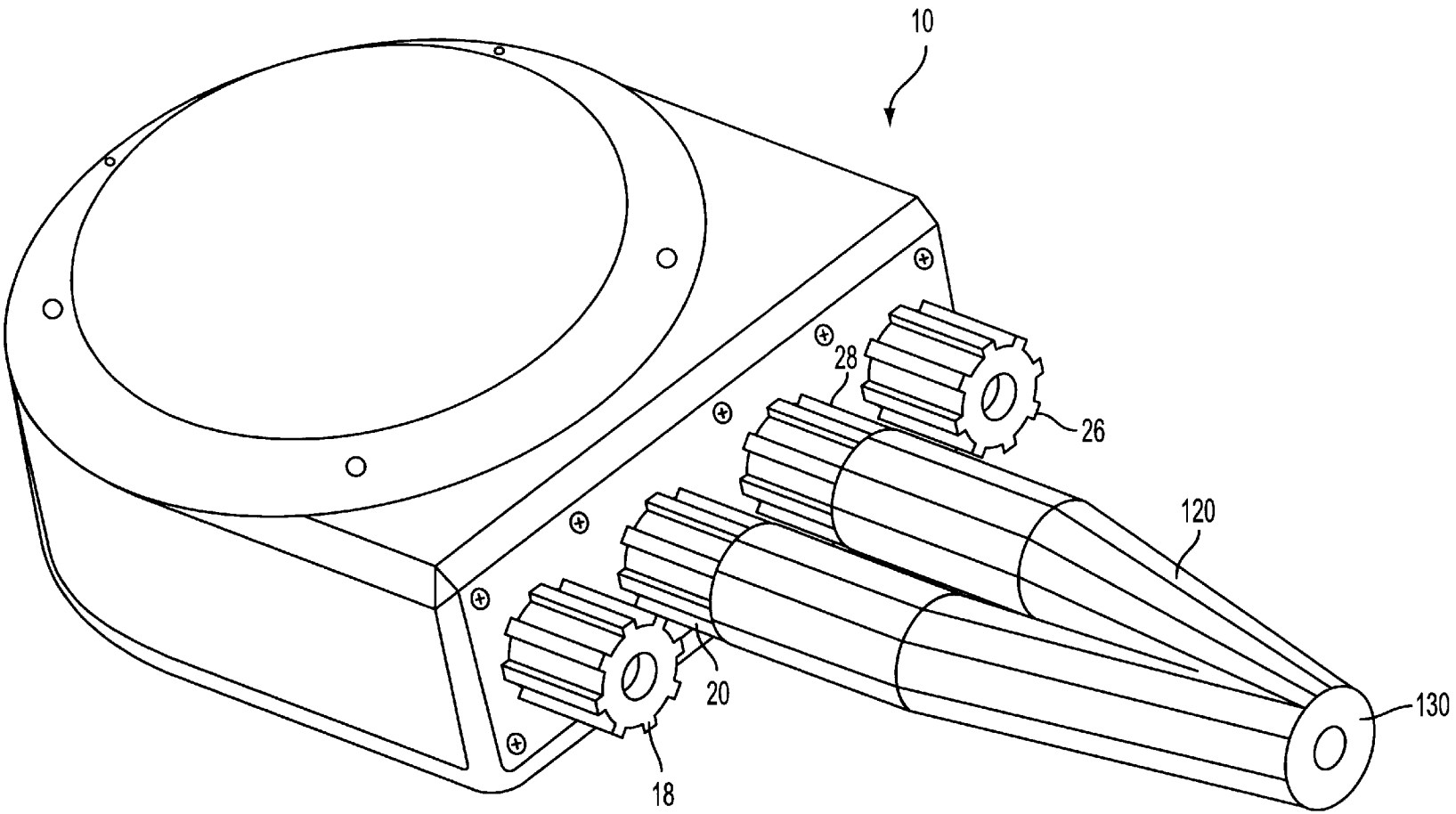
FIG. 15 depicts the dual pump according to a further embodiment of the invention for providing a continuous, non-pulsated supply of a single liquid.
Figure 16A:
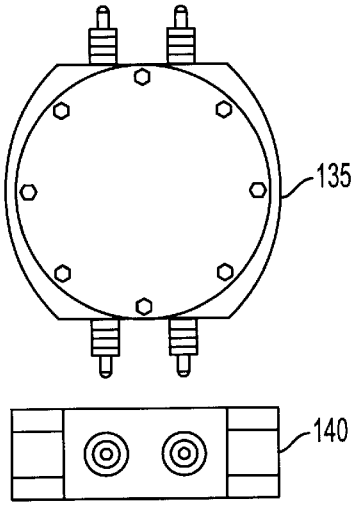
FIGS. 16A to 16J depict alternative configurations of the dual pump according to a further embodiment of the invention.
Figure 16B:
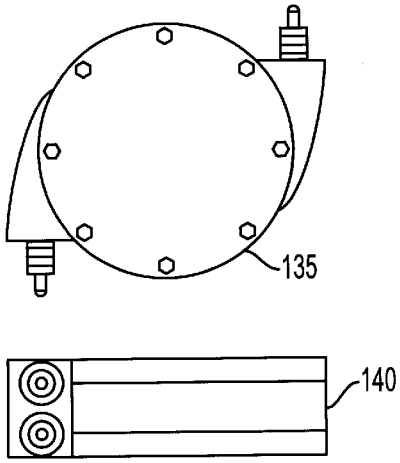
Figure 16C:
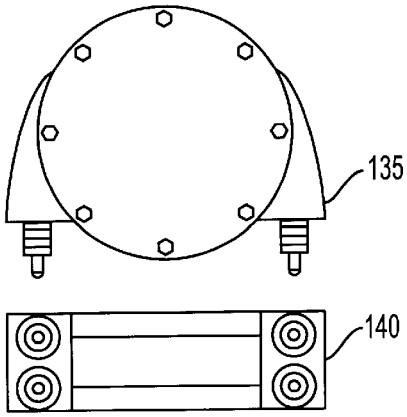
Figure 16D:
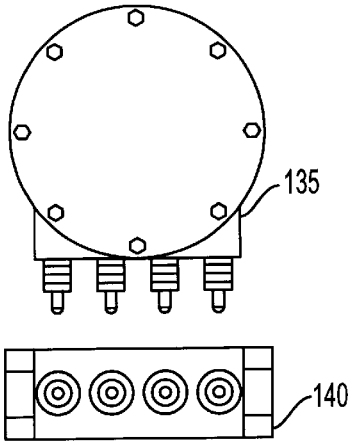
Figure 16E:
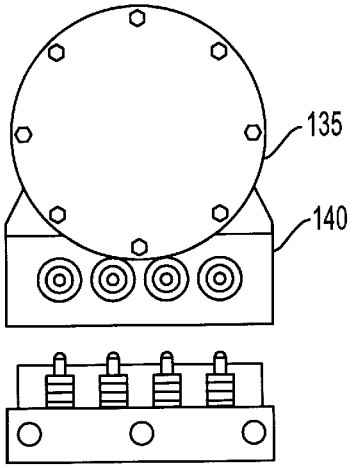
Figure 16F:
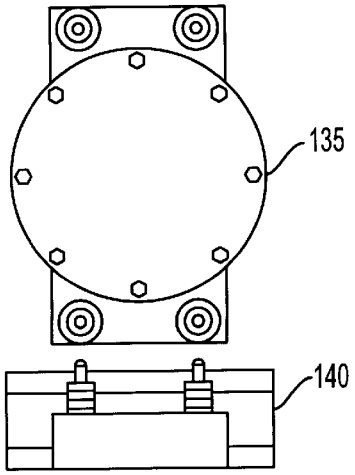
Figure 16G:
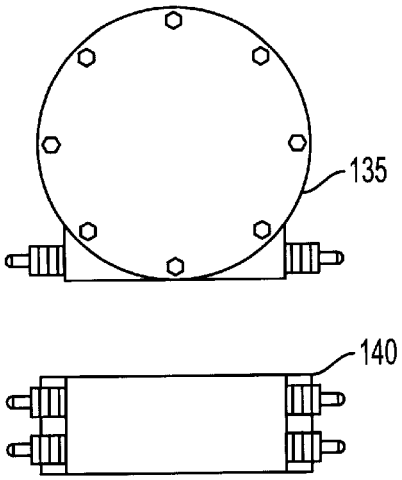
Figure 16H:
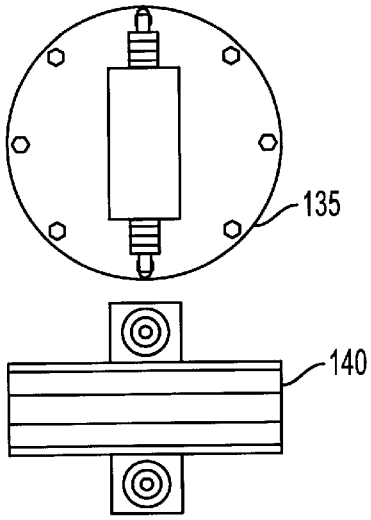
Figure 16I:
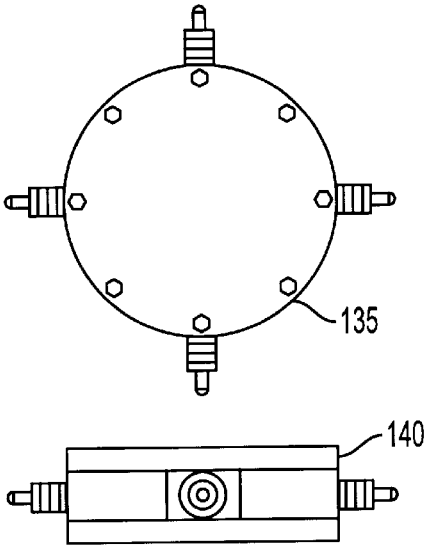
Figure 16J:
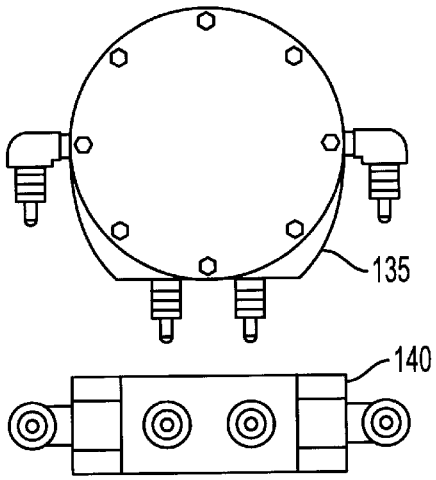

A further embodiment of the dual pump 10, is depicted with reference to FIG. 15. FIG. 15 depicts the dual pump 10, configured to provide a continuous, non-pulsated flow of a single liquid. The dual pump 10, further includes an outlet attachment port 120 coupled to the first outlet port 20 and the second outlet port 28, such that the first outlet fluid path 78 and said second outlet fluid path 92 (see FIG. 5) are joined thereby combining the first fluid and the second fluid at an output 130 of the outlet attachment port 120. In addition, the pump regulator 110 (see FIG. 8) is further configured to provide driving pressure to the first 30 and second 34 pump diaphragms (see FIGS. 9 and 10) such that the single liquid continuously flows out of the output 130 of the outlet attachment port 120. The continuous, non-pulsed flow of the single liquid from the dual pump is accomplished by timing the movement of the diaphragms, such that while one of the pump chambers is filling with the single liquid, the opposed chamber is emptying and expelling the liquid from the output 130 of the outlet attachment port 120 and out of the dual pump 10.

It is emphasized that various configurations and arrangements may be used without departing from the scope of the invention. Specifically, FIGS. 16A to 16J depict alternative configurations of the dual pump 10 inlet (18 & 26) and outlet (20 & 28) ports. FIGS. 16A to 16J depict a top view 135 and side view 140 of the dual pump 10, illustrating the various inlet (18 & 26) and outlet (20 & 28) port configurations within the contemplation of the present invention.

Figure 14:
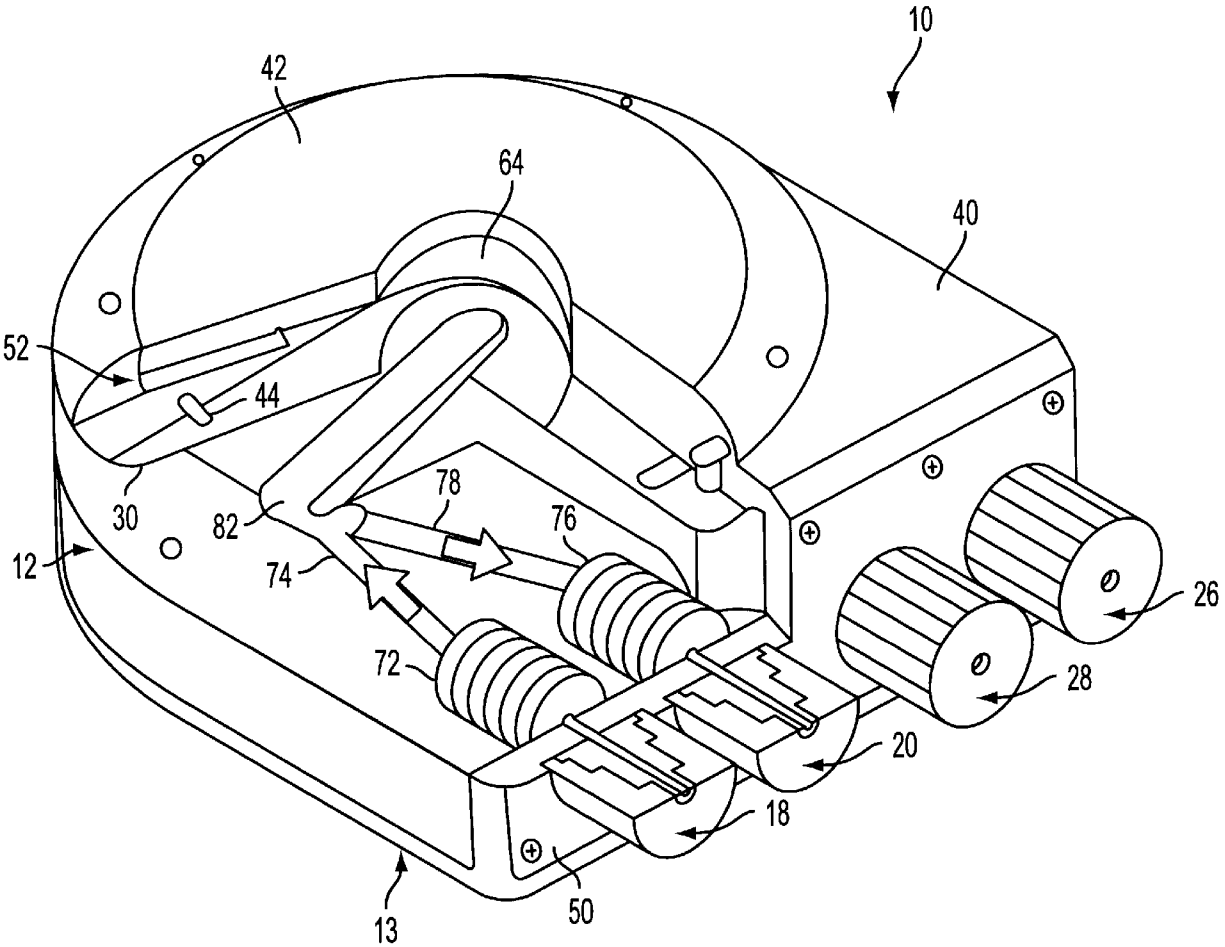
FIG. 14 depicts the dual pump according to a further embodiment of the invention.
Figure 17:
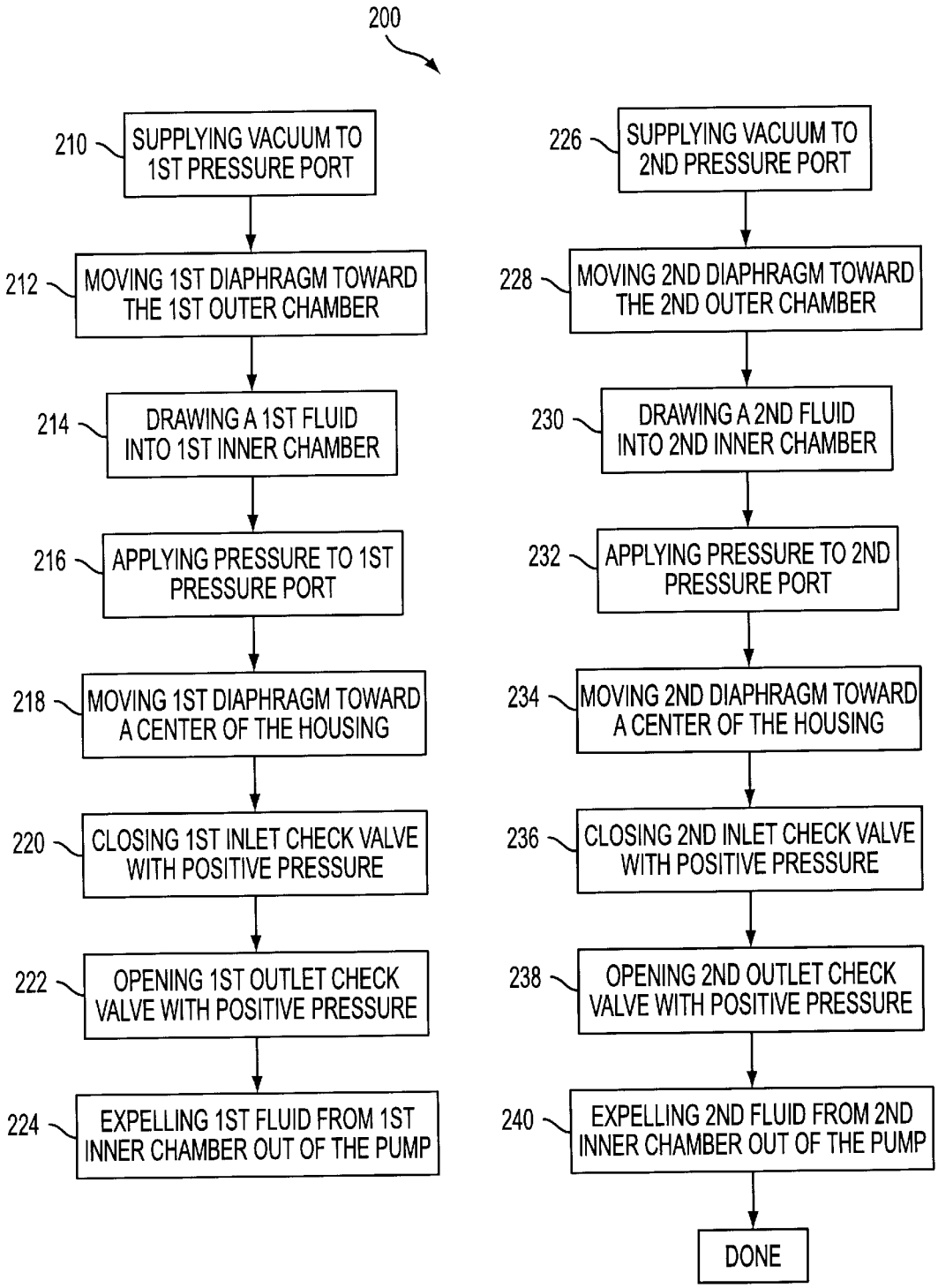
FIG. 17 is a flow chart depicting procedural steps for independently pumping two distinct fluids with the dual pump of the present invention.

Operation of the invention is shown in FIG. 17 as a method 200 of independently pumping two fluids using a dual pump 10, for example as depicted in FIGS. 8 and 14. At step 210, vacuum is supplied to the first pressure port 52 to create a negative pressure in the first outer chamber 60. At step 212, the first diaphragm 30 is moved toward the first outer chamber 60 to create a negative pressure in the first inner chamber 32. At step 214, a first fluid 11 is drawn into the first inner chamber 32 past the first inlet check valve 72 while the first outlet check valve 76 is closed with the negative pressure. At step 216, pressure is applied to the first pressure port 52 to create a positive pressure in the first outer chamber 60. At step 218, the first diaphragm 30 is forced towards a center 80 of the housing 12 to create a positive pressure in the first lower chamber 32. At step 220, the first inlet check valve 72 is closed with the positive pressure. At step 222, the first outlet check valve 76 is opened with the positive pressure. At step 224, the first fluid 11 is expelled from the first inner chamber 32 and out of the pump 10.

Pumping a second fluid 13 in the dual pump 10 independent of the first fluid 11 comprises the following steps performed simultaneously with the aforementioned steps for pumping the first fluid 11. At step 236, vacuum is supplied to the second pressure port 56 to create a negative pressure in the second outer chamber 62. At step 228, the second diaphragm 34 is moved toward the second outer chamber 62 to create a negative pressure in the second inner chamber 36. At step 230, a second fluid 13 is drawn into the second chamber 36 past the second inlet check valve 86 while the second outlet check valve 90 is closed with the negative pressure. At step 232, pressure is applied to the second pressure port 56 to create a positive pressure in the second outer chamber 62. At step 232, the second diaphragm 34 is forced toward a center 80 of the housing 12 create a positive pressure in the second lower chamber 36. At step 236, the second inlet check valve 86 is closed with the positive pressure. At step 238, the second outlet check valve 90 is opened with the positive pressure. At step 240, the second fluid 13 is expelled from the second inner chamber 36 and out of the pump 10, independent of the first fluid 11.

Figure 18:
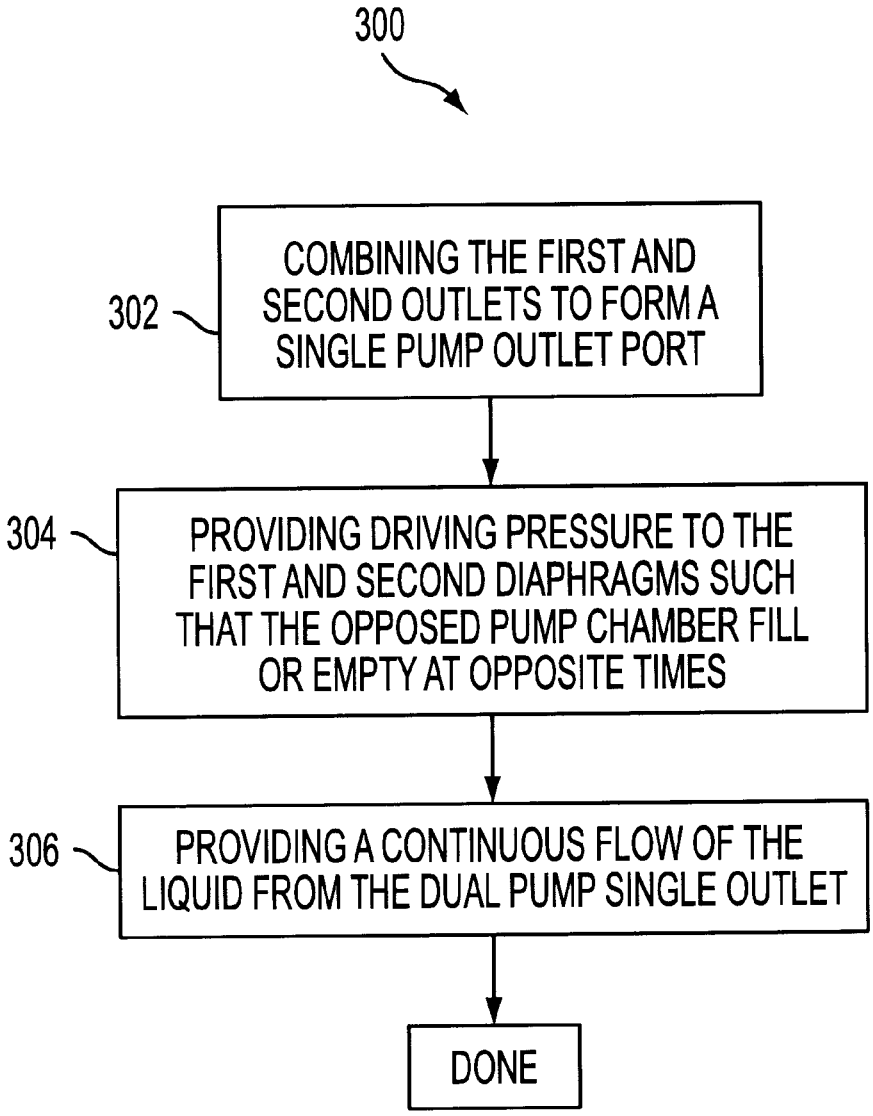
FIG. 18 is a flow chart depicting procedural steps for providing a continuous non-pulse flow of a single with the dual pump of the present invention.

Operation of the invention according to a further embodiment of the invention is shown in FIG. 18 as a method 300 of providing a continuous, non-pulsed flow of a single liquid from the dual pump 10, for example as depicted in FIG. 15. At step 302, the first outlet port 20 and the second outlet port 28 are combined to form a single pump outlet port 120. At step 304, a driving pressure is provided to the first 30 and second 34 diaphragms, such that while one of the chambers is filled with the single liquid, the single liquid is expelled from the opposed chamber. At step 304, a continuous, non-pulsed flow of the single liquid is provided through the single pump outlet port 120 and out of the dual pump 10. This is accomplished, for example, by simultaneously applying vacuum to one of the chambers to create a negative pressure in the outer chamber thereby causing the single liquid to enter the chamber and applying driving pressure to the opposed chamber to create a positive pressure in the opposed outer chamber thereby causing the single liquid to exit the opposed chamber and continuously flow out of the dual pump 10 in a non-pulsed manner.

Exemplary embodiments are described with reference to specific configurations. Those skilled in the art will appreciate that various changes and modifications can be made while remaining within the scope of the claims. For example, the dual pump can use virtually any means to create vacuum or pressure within the chambers to draw fluid into the pump. In addition, the check valves may be replaced with other known systems for controlling the flow of liquid into or out of the system. Moreover, various inlet and outlet port configurations are possible while remaining within the scope of the claims. The invention provides many advantages over known techniques. The invention discloses a compact dual pump with the ability to precisely pump the required liquid to a tool. In addition, the dual pump can simultaneously and independently provide two fluid chemistries in substantially the same space used by a conventional pump.

Having disclosed exemplary embodiments and the best mode, modifications and variations may be made to the disclosed embodiments while remaining within the scope of the invention as defined by the following claims.

What is claimed is:

1. A dual pump for pumping a first fluid and a second fluid independently, comprising:

a pump body, including:

(a) a first concave depression on a first side of said pump body;

(b) a first inlet fluid port and a first outlet fluid port in fluid communication with said first depression;

(c) a second concave depression on a second side of said pump body opposite said first depression; and (d) a second inlet fluid port and a second outlet fluid port in fluid communication with said second depression;

a first diaphragm coupled to said first side of said pump body and enclosing said first depression to form a first inner chamber;

a second diaphragm coupled to said second side of said pump body and enclosing said second depression to form a second inner chamber;

a shell enclosing said pump body on said first and second sides of said pump body, said shell defining a first outer chamber with said first diaphragm in pressure communication with said first inner chamber and defining a second outer chamber with said second diaphragm in pressure communication with said second inner chamber;

a first pressure port in said shell providing a first pressure passage to said first outer chamber; and a second pressure port in said shell providing a second pressure passage to said second outer chamber.

2. The dual pump of claim 1, wherein said pump body further includes:

a pair of first bores in alignment with said first fluid ports;

a first inlet check valve contained within one of said first bores and defining a first inlet fluid path connecting said first inlet fluid port to said first inner chamber and allowing said first fluid to flow into said first inner chamber from said first inlet port;

a first outlet check valve contained within another of said first bores and defining a first outlet fluid path joining said first inlet fluid path at a center portion of said body to form a first fluid path to said first inner chamber, thereby allowing said first fluid to flow out of said first inner chamber through said first outlet port;

a pair of second bores in alignment with said second fluid ports;

a second inlet check valve contained within one of said second bores and defining a second inlet fluid path connecting said second inlet fluid port to said second inner chamber and allowing said second fluid to flow into said second inner chamber from said second inlet port; and a second outlet check valve contained within another of said second bores and defining a second outlet fluid path joining said second inlet fluid path at said center portion of said body to form a second fluid path to said second inner chamber, thereby allowing said second fluid to flow out of said second inner chamber through said second outlet port.

3. The dual pump of claim 2, further comprising:

a module card containing a first control valve in fluid communication with said first pressure port, and a second control valve in fluid communication with said second pressure port, said control valves independently providing either vacuum or pressure to said first and second diaphragms to affect fluid movement; and a pump regulator in fluid communication with said module card and configured to provide driving pressure for said first and second diaphragms.

4. The dual pump of claim 1, wherein:

said first outer chamber is a first pneumatic chamber and said first inner chamber is a first fluid chamber in pressure communication with said first pneumatic chamber;

said second outer chamber is a second pneumatic chamber and said second inner chamber is a second fluid chamber in pressure communication with said second pneumatic chamber; and said shell further comprises:

(a) a first end cap coupled to said first side of said pump body, for carrying said first diaphragm therebetween, and defining said first pneumatic chamber between said first end cap and said first diaphragm;

(b) a first o-ring contained within said first pneumatic chamber and coupled between said first diaphragm and said first end cap;

(c) a second end cap coupled to said pump body for carrying said second diaphragm therebetween and defining said second pneumatic chamber between said second diaphragm and said second end cap;

(d) a second o-ring contained within said second pneumatic chamber and coupled between said second diaphragm and second end cap; and (e) a cinch plate coupled to said pump body and connecting said first inlet and outlet ports and said second inlet and outlet ports to said pump body.

5. The dual pump of claim 4, wherein said pump body further includes:

a pair of first bores coupled to said first fluid ports;

a first inlet check valve contained within one of said first bores and defining a first inlet fluid path connecting said first inlet fluid port to said first fluid chamber and allowing said first fluid to flow into said first fluid chamber from said first inlet port;

a first outlet check valve contained within another of said first bores and defining a first outlet fluid path joining said first inlet fluid path at said center portion of said body to form a first fluid path to said first fluid chamber, thereby allowing said first fluid to flow out of said first fluid chamber through said first outlet port;

a pair of second bores coupled to said second fluid ports;

a second inlet check valve contained within one of said second bores and defining a second inlet fluid connecting said second inlet fluid port to said second fluid chamber and allowing said second fluid to flow into said second fluid chamber from said second inlet port; and a second outlet check valve contained within another of said second bores and defining a second outlet fluid path joining said second inlet fluid path at said center portion of said body to form a second fluid path to said second fluid chamber, thereby allowing said second fluid to flow out of said second fluid chamber through said second outlet port.

6. The dual pump of claim 5, further comprising:

a module card containing a first pneumatic control valve in gas communication with said first pressure port, and a second pneumatic control valve in gas communication with said second pressure port, said pneumatic control valves independently providing either vacuum or pressure to said first and second diaphragms to affect fluid movement; and a pump regulator in gas communication with said module card, configured to provide driving pressure for said first and second pump diaphragms and including a connector for coupling to a CDA/N2 source.

7. The dual pump of claim 6, further comprising:

a first pneumatic gas line connecting said first pneumatic control valve to said first pressure port;

a second pneumatic gas line connecting said second pneumatic control valve to said second pressure port; and a vacuum switch coupled to each of said pneumatic control valves and configured to detect inadequate vacuum from said pump or leak detection from said pneumatic lines.

8. The dual pump of claim 7, further comprising:

an outlet attachment port coupled to said first outlet port and said second outlet port, such that said first outlet fluid path and said second outlet fluid path are joined thereby combining said first fluid and said second fluid at an output of said outlet attachment port; and wherein said pump regulator is configured to provide driving pressure for said first and second pump diaphragms such that the single liquid continuously flows out of said output of said outlet attachment port.

9. A method of independently pumping two fluids using a dual pump having a single housing containing opposed first and second chambers, first inlet and outlet check valves in fluid communication with the first chamber, second inlet and outlet check valves in fluid communication with the second chamber, a first diaphragm enclosing the first chamber to define a first inner chamber and coupled to the housing by a first end cap having a first pressure port and defining a first outer chamber therebetween and a second diaphragm enclosing the second chamber to define a second inner chamber and coupled to the housing by a second end cap having a second pressure port and defining a second outer chamber therebetween, said method comprising the steps of:

pumping a first fluid in the dual pump by:

(a) supplying vacuum to the first pressure port to create a negative pressure in the first outer chamber, (b) moving the first diaphragm toward the first outer chamber to create a negative pressure in the first inner chamber;

(c) drawing a first fluid into the first inner chamber past the first inlet check valve while the first outlet check valve is closed with the negative pressure;

(d) applying pressure to the first pressure port to create a positive pressure in the first outer chamber;

(e) moving the first diaphragm towards a center of the housing create a positive pressure in the first lower chamber;

(f) closing the first inlet check valve with said positive pressure;

(g) opening the first outlet check valve with said positive pressure; and (h) expelling the first fluid from the first inner chamber and out of the pump;

independently pumping a second fluid in the pump by:

(a) supplying vacuum to the second pressure port to create a negative pressure in the second outer chamber;

(b) moving the second diaphragm toward the second outer chamber to create a negative pressure in the second inner chamber, (c) drawing a second fluid into the second chamber past the second inlet check valve while the second outlet check valve is closed with the negative pressure;

(d) applying pressure to the second pressure port to create a positive pressure in the second outer chamber;

(e) moving the second diaphragm towards a center of the housing create a positive pressure in the second lower chamber;

(f) closing the second inlet check valve with said positive pressure;

(g) opening the second outlet check valve with said positive pressure; and (h) expelling the second fluid from the second inner chamber and out of the pump.

10. A method of continuously pumping a single liquid using a dual pump having a single housing containing opposed first and second chambers, first inlet and outlet ports in fluid communication with the first chamber, second inlet and outlet ports in fluid communication with the second chamber, a first diaphragm enclosing the first chamber to define a first inner chamber and coupled to the housing by a first end cap having a first pressure port and defining a first outer chamber therebetween and a second diaphragm enclosing the second chamber to define a second inner chamber coupled to the housing by a second end cap having a second pressure port and defining a second outer chamber therebetween, said method comprising the steps of:

(a) combining the first outlet port and the second outlet port to form a single pump outlet port;

(b) providing a driving pressure to the first and second diaphragms such that while one of the chambers is filled with the single liquid, the single liquid is expelled from the opposed chamber; and (c) providing a continuous, non-pulsed flow of the single liquid through the single pump outlet port and out of the dual pump.

* * * * *